United States Patent [19]

Mage

[11] Patent Number: 4,708,911

[45] Date of Patent: Nov. 24, 1987

[54] THREE DIMENSIONAL DISPLAY DEVICE FOLDED FROM A SINGLE SHEET OF MATERIAL

[76] Inventor: Allen B. Mage, 5113 Baltimore St., Los Angeles, Calif. 90042

[21] Appl. No.: 886,652

[22] Filed: Jul. 18, 1986

[51] Int. Cl.[4] ..... A63H 33/16

[52] U.S. Cl. ..... 428/542.8; 428/12; 493/405; 493/955

[58] Field of Search ..... 428/12, 542.8; 493/405, 493/955

[56] References Cited

U.S. PATENT DOCUMENTS

| | | | |
|---|---|---|---|
| 2,333,569 | 11/1943 | Higgins | 493/405 X |
| 3,207,357 | 9/1965 | Schmitt | 428/542.8 X |
| 3,267,597 | 8/1966 | Jannes | 428/12 X |
| 3,878,638 | 4/1975 | Benjamin | 428/542.8 X |
| 4,001,964 | 1/1977 | Hooker | 493/405 X |
| 4,021,950 | 5/1977 | Asija | 428/542.8 X |
| 4,227,334 | 10/1980 | Hooker | 493/405 X |
| 4,517,251 | 5/1985 | Mosely | 428/542.8 |

*Primary Examiner*—Henry F. Epstein
*Attorney, Agent, or Firm*—Robert J. Schaap

[57] ABSTRACT

A decorative display device which is capable of being folded from a relatively flat single sheet of material into a three dimensional object. The sheet of material is provided with fold lines for defining areas to be folded and score lines defining areas to be cut and/or removed. In one embodiment, the sheet of material can serve as a poster or similar single sheet art decorative item. When folded and properly assembled, the sheet becomes a three dimensional display device which can also provide a utilitarian function, such as serving as a storage container, or the like. The display device has a surface contour which conforms to and co-operates with a pattern on the sheet of material. Thus, for example, a flag having a plurality of stripes may be printed on the sheet of material. When folded into the decorative display device the stripes co-act with and form raised and depressed areas in the surface contour of the decorative display device.

31 Claims, 13 Drawing Figures

THREE DIMENSIONAL DISPLAY DEVICE FOLDED FROM A SINGLE SHEET OF MATERIAL

BACKGROUND OF THE INVENTION

1. Field of the Invention

This invention relates in general to certain new and useful improvements in three dimensional decorative display devices and more particularly, to three dimensional decorative display devices which are capable of being folded from a single sheet of foldable material into such three dimensional form and which sheet of material has a pattern or design conforming to and co-operating with the surface contour of the display device when formed.

2. Brief Description of the Prior Art

There have been numerous decorative display devices and other forms of devices in the prior art which can be folded from a single sheet of paper or similar material into a three dimensional object. For example, children's craft toys often contain sheets of paper or paperboard material having fold lines to identify regions to be folded and possibly score lines to identify regions to be cut and/or removed. These fold lines and score lines thereby provide some guideline and in effect, instructions which enable a child to fold the sheet of material into a three dimensional object.

Heretofore, there has not been any single sheet of foldable material which has a design on the exterior surface and which can be folded into a three dimensional display device with a major portion of the design conforming to and co-operating with the surface contour of the device which is formed, to thereby provide an aesthetically pleasing and useful article. More specifically, there has not been any three dimensional display device which has a flag design on the exterior surface and with the flag design conforming to and actually co-operating with the surface contour of the device to create a unique appearance. In addition, there has not been any such three dimensional device which was folded from a single sheet of paper or paperboard material where the sheet of material, in and of itself, served as a poster or similar single sheet display object.

OBJECTS OF THE INVENTION

It is, therefore, one of the primary objects of the present invention to provide a sheet of foldable material having a design on its surface and which can be folded into a three dimensional device with the design conforming to and co-operating with the surface contour of the three dimensional device thus formed.

It is another object of the present invention to provide a three dimensional display device having a design on its exterior surface and which conforms to and generally co-operates with the surface contour of the device to provide a unique appearance and surface configuration.

It is a further object of the present invention to provide a sheet of material of the type stated which is highly effective in serving as a single sheet decorative display art object and which when folded into a three dimensional device, provides a unique outer design on the three dimensional device.

It is also an object of the present invention to provide a sheet of material of the type stated having a design of a flag on the surface thereof and which can be folded into a three dimensional display device with the flag on the surface of the device and with certain portions of the flag co-operating with and corresponding to contoured sections on the surface of the three dimensional display device.

It is an additional object of the present invention to provide a three dimensional display device of the type stated which is highly effective as a craft device for both children and adults and which can be constructed at a relatively low unit cost.

It is still another object of the present invention to provide a method of making a three dimensional display device from a single sheet of foldable material and which sheet of material provides a design on its exterior surface of the display which forms part of and conforms to a surface contour of the display device thus formed.

With the above and other objects in view, my invention resides in the novel features of form, construction, arrangement and combination of parts presently described and pointed out in the claims.

BRIEF SUMMARY OF THE DISCLOSURE

Generally speaking, the present invention relates to a single sheet of foldable material having a design on the exterior surface and which can be folded and otherwise formed into a three dimensional display device having that design conforming to and co-operating with the surface contour of the device thus formed. In a preferred embodiment, the single sheet of material is capable of functioning as a single sheet object, such as a poster, or the like, and which when folded, will serve as a three dimensional art object or as a utilitarian object having other purposes.

The single sheet of foldable material in accordance with the present invention is preferably provided with a plurality of fold lines such that the sheet of material can be folded into the three dimensional display device. These fold lines usually comprise a first set of generally parallel horizontally extending fold lines and a second set of generally parallel vertically disposed fold lines. Further, the single sheet of material is also provided with a third set of fold lines which are diagonally located with respect to both of the first and second sets of fold lines and often intersect certain of the first and second fold lines in regions near the intersections of the first and second fold lines.

Certain areas of the single sheet of material may also be provided with score lines and certain of the fold lines may also be score lines, as well. The score lines are provided for cutting or severing portions of the sheet of material and in some cases, removing portions of the sheet of material where not needed to complete the three dimensional display device.

When the single sheet of material is cut or otherwise formed in such manner as to have portions thereof removed, various horizontal segments will be obtained on the single sheet of material between the horizontally disposed set of fold lines. Certain of the alternating segments will have a horizontal dimension which is greater than other of the alternating segments. In this way, when the sheet of material is folded into a three dimensional display device, individual segments on the enclosing side wall of the device will protrude beyond other of the individual segments forming part of the side wall. For example, certain of the side wall sections will have a length greater than alternating segments and will also extend beyond the surfaces of these alternating segments.

The three dimensional display device, in a preferred embodiment, comprises an enclosing side wall formed of front and back parallel side walls connected by spaced apart and opposed end walls. The display device also includes a top wall extending across the side walls and end walls and a bottom flap capable of being disposed over an initially open lower end to close an interior compartment.

This invention possesses many other advantages and has other purposes which may be made more clearly apparent from a consideration of the forms in which it may be embodied. These forms are shown in the drawings forming part of and accompanying the present specification. They will now be described in detail for purposes of illustrating the general principles of the invention, but it is to be understood that such detailed descriptions are not to be taken in a limiting sense.

BRIEF DESCRIPTION OF THE DRAWINGS

Figure 1:
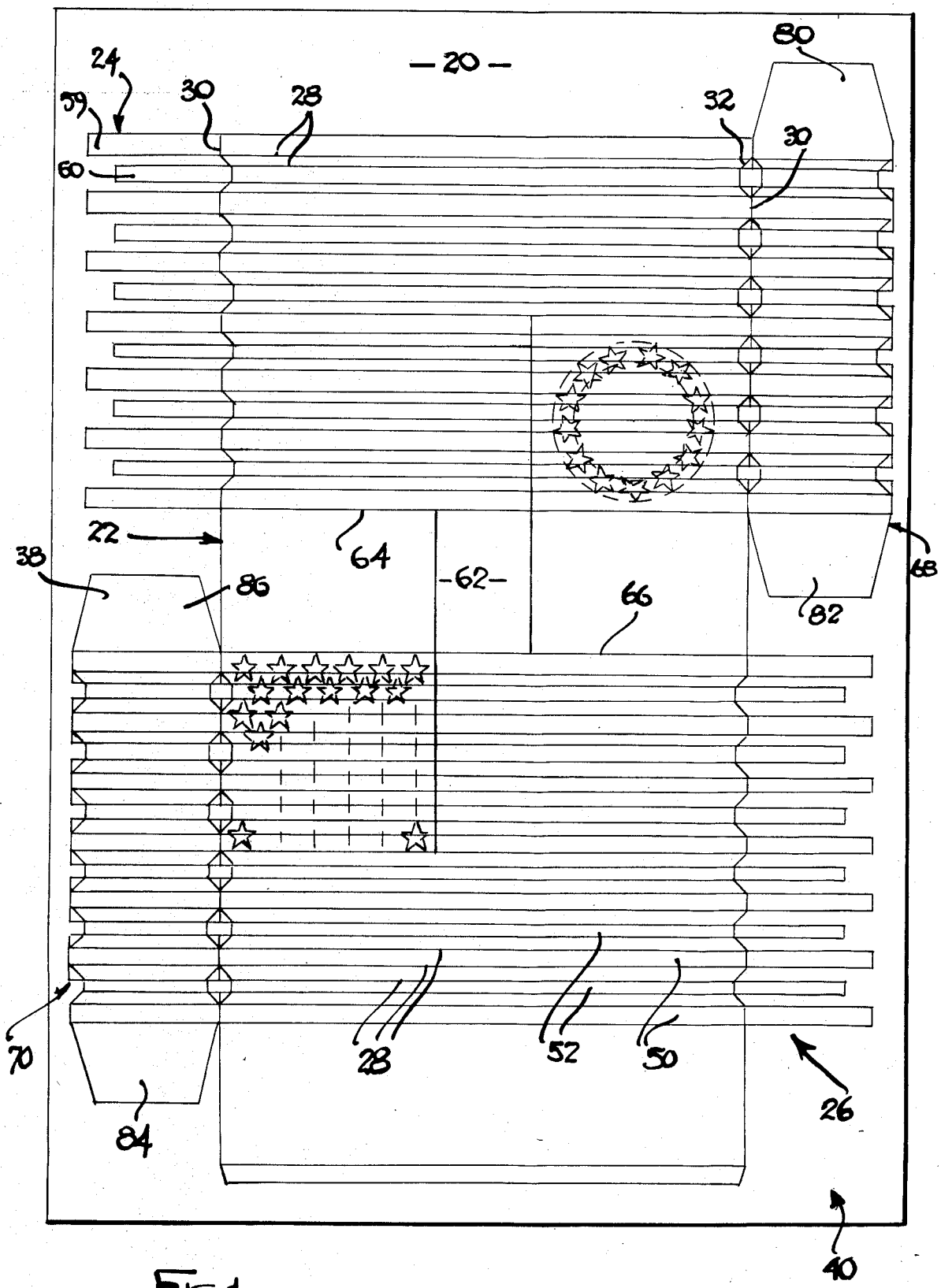
Figure 2:
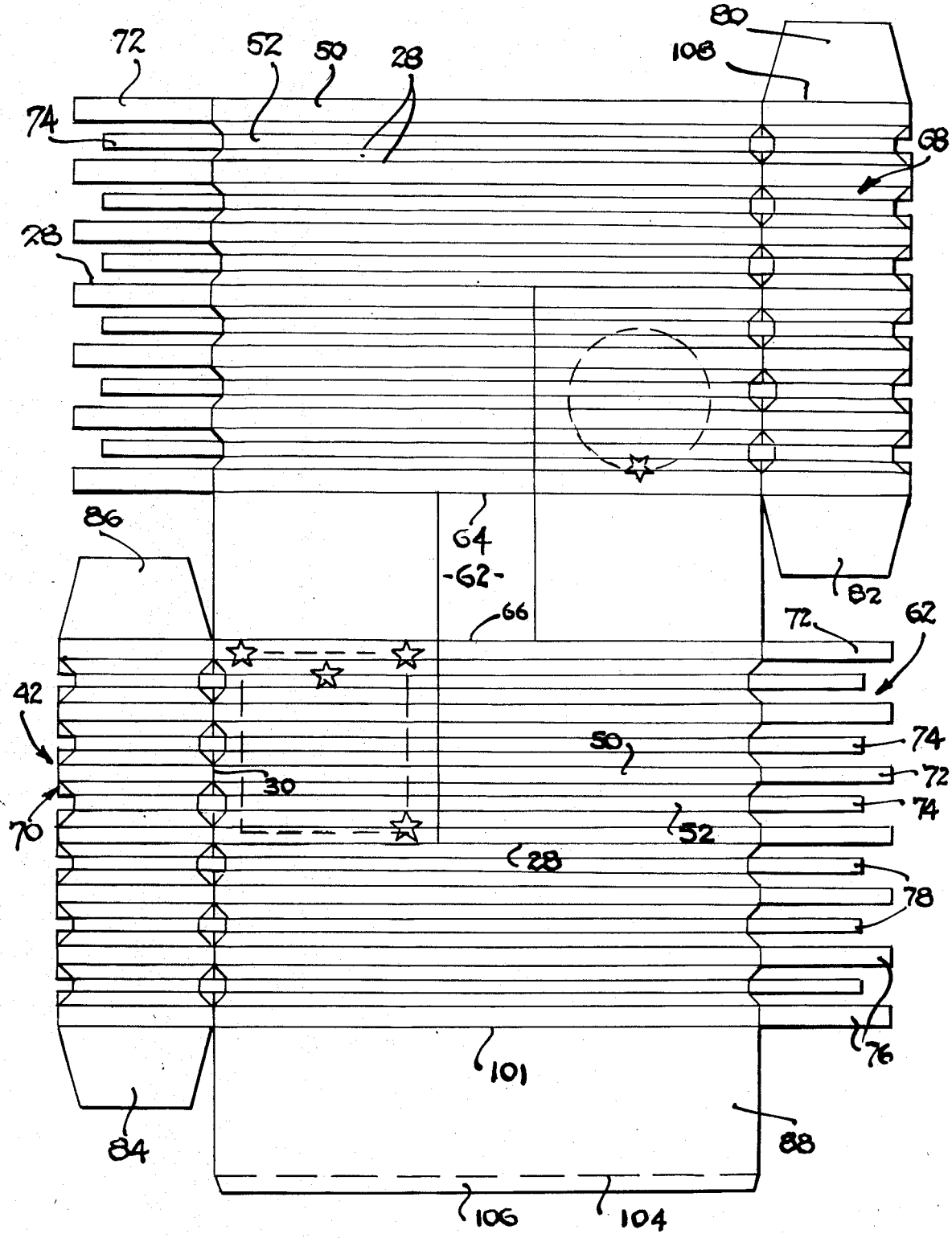
Figure 3:
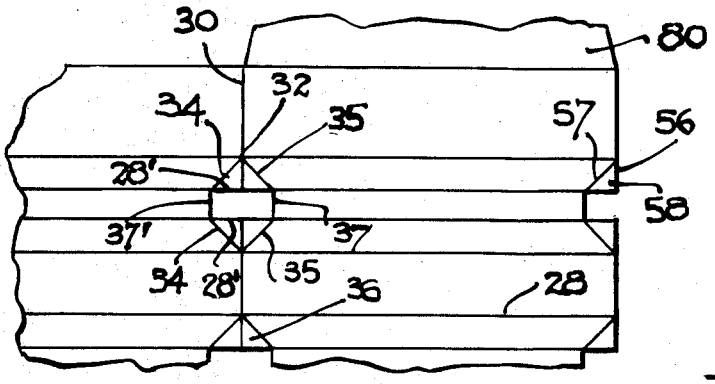
Figure 3A:
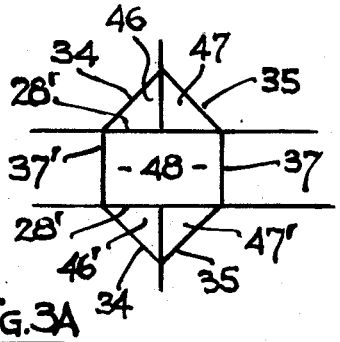
Figure 4:
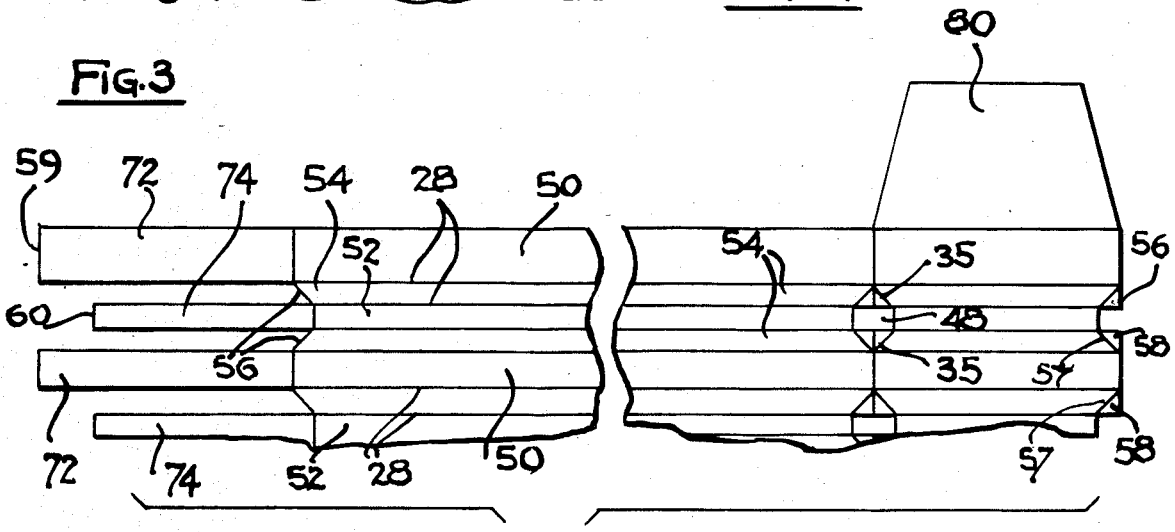
Figure 5:
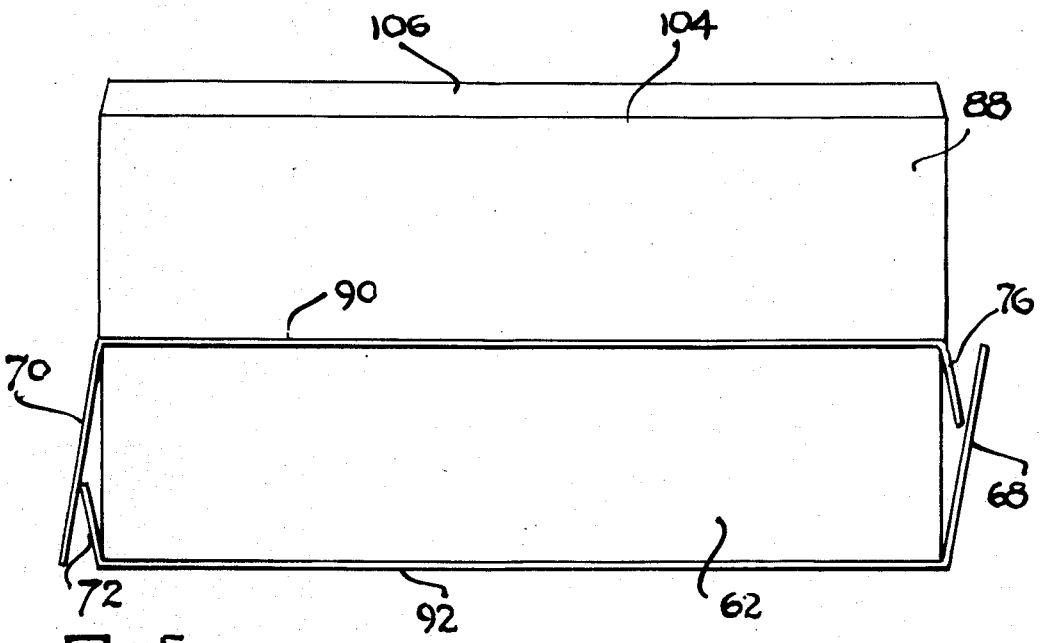
Figure 6:
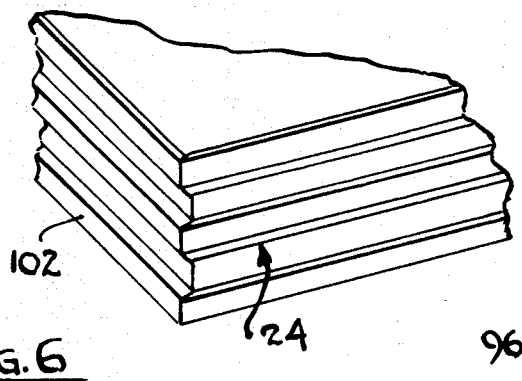
Figure 7:
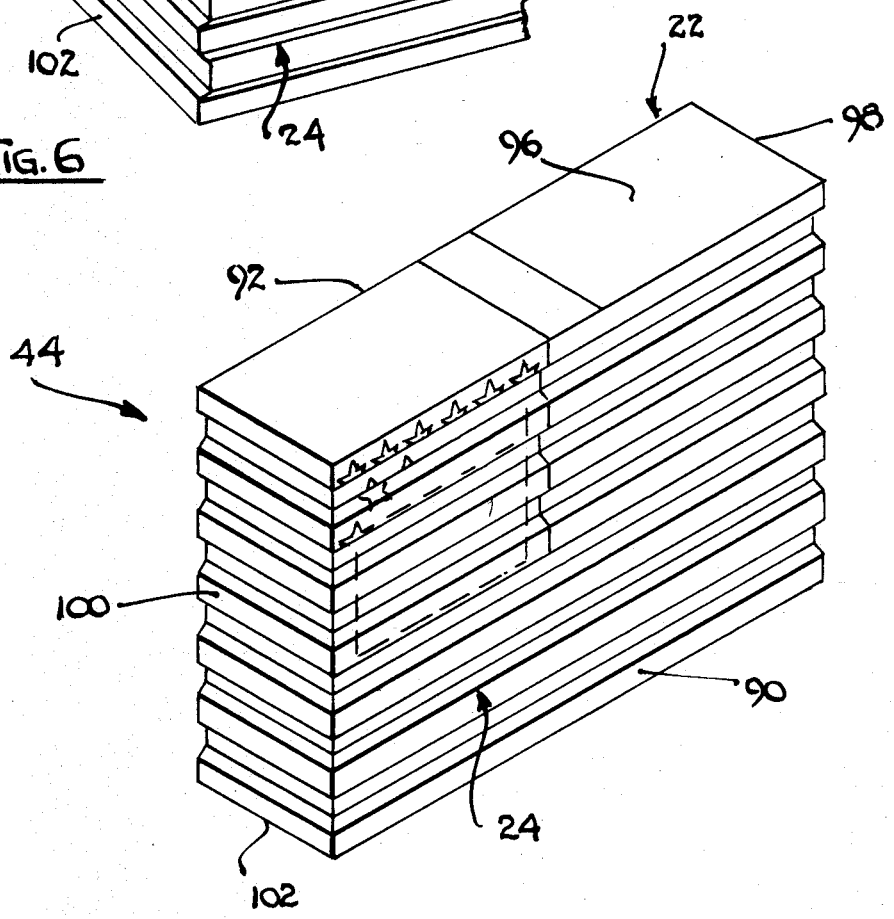
Figure 8:
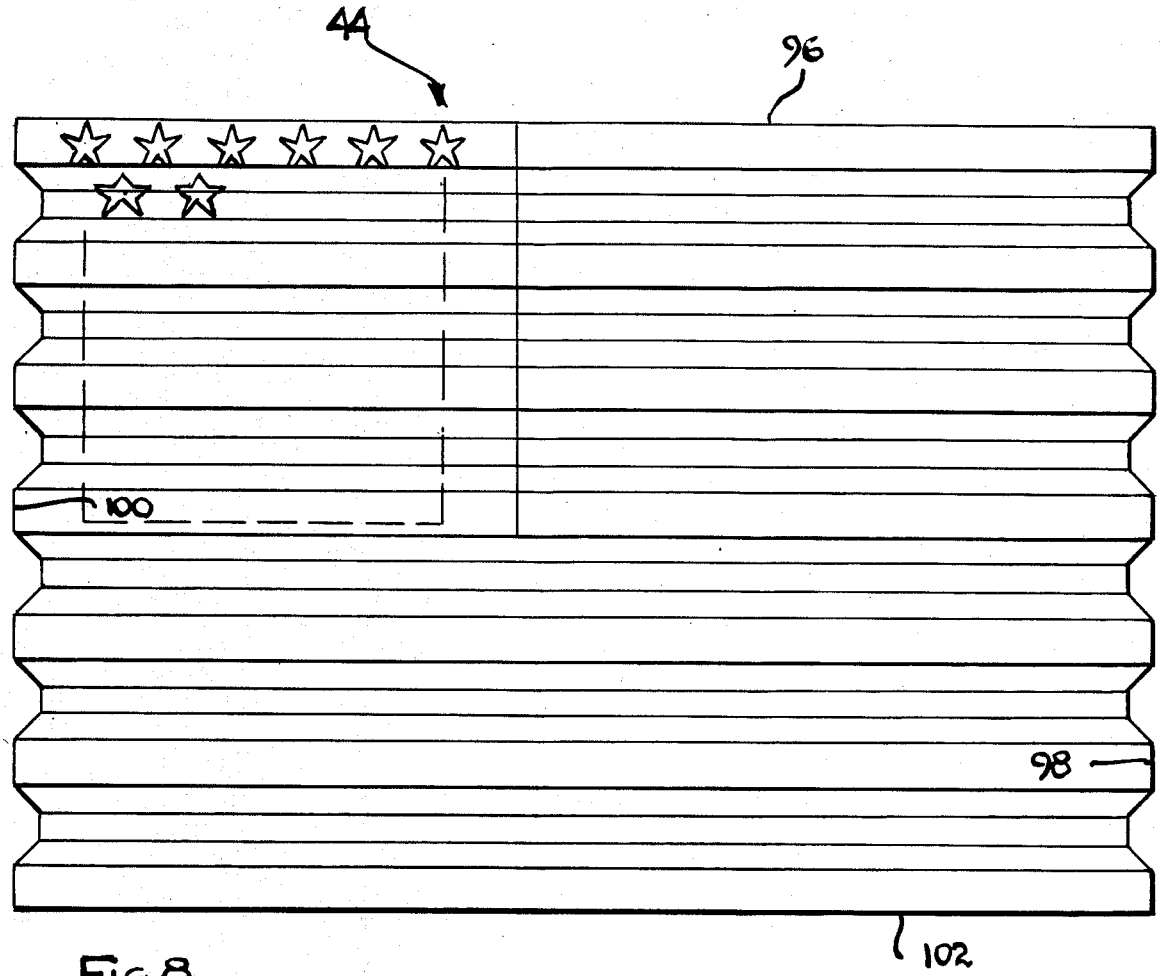
Figure 10:
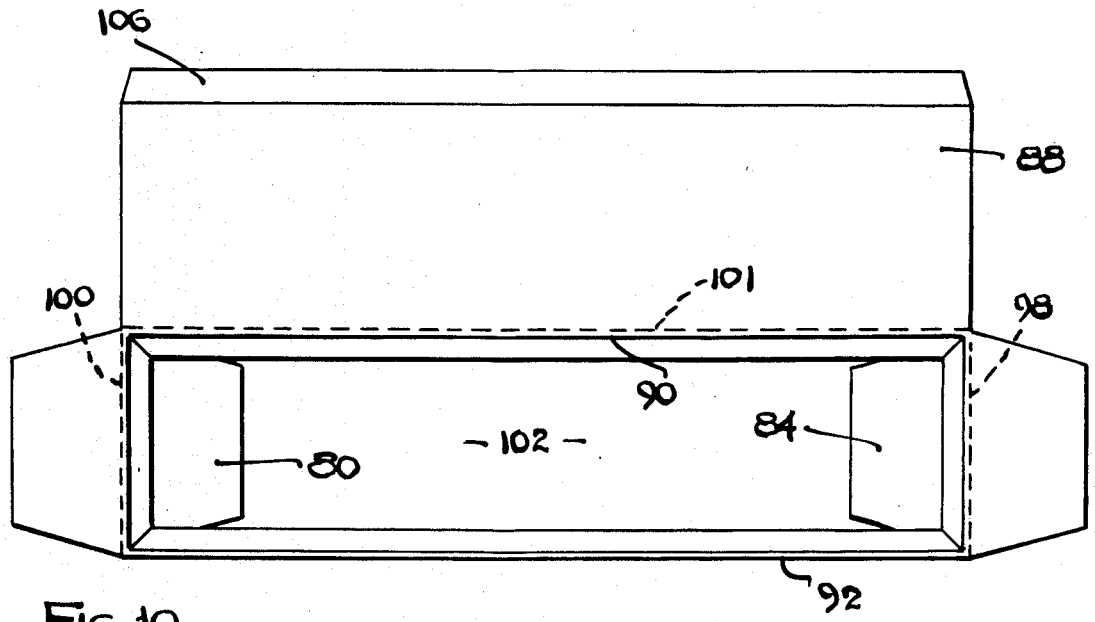
Figure 9:
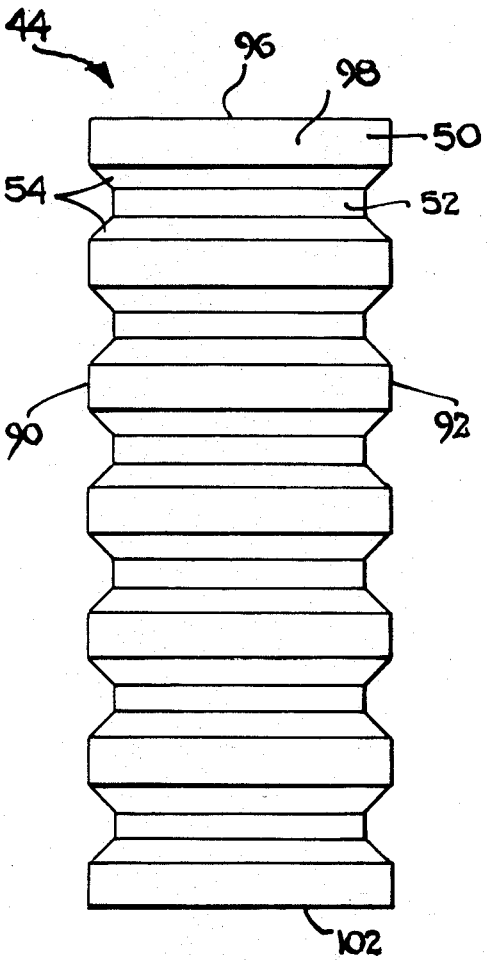
Figure 11:
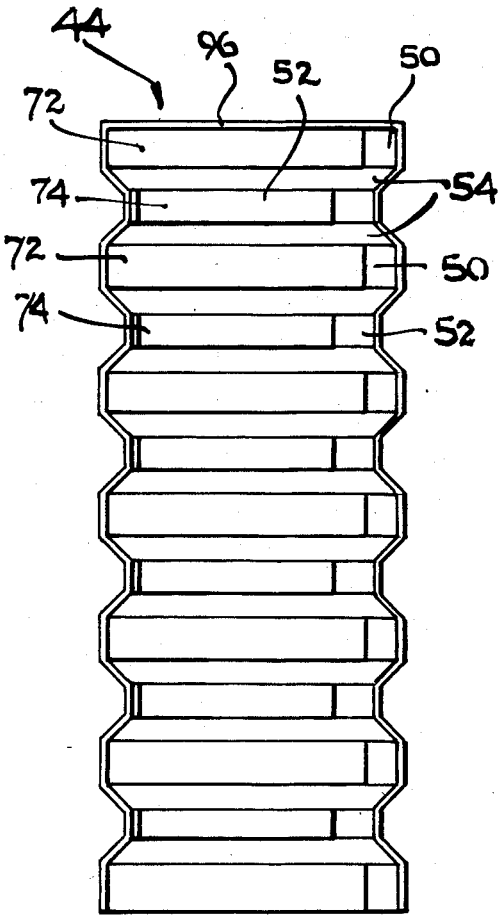
Figure 12:
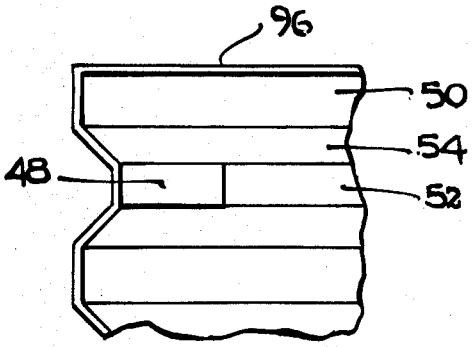

Having thus described the invention in general terms, reference will now be made to the accompanying drawings (six sheets) in which:

FIG. 1 is a front elevational view of a sheet of material which may be folded to form the three dimensional display device of the present invention;

FIG. 2 is a front elevational view of the sheet of material of FIG. 1 with peripheral portions removed to form an outline of a display member capable of being folded into the three dimensional display device;

FIG. 3 is an enlarged front elevational view of a portion of the sheet of FIG. 1 and showing a plurality of fold lines and score lines which form a corner portion of the three dimensional display device;

FIG. 3A is an enlarged elevational view of a portion of the sheet in FIG. 3;

FIG. 4 is an enlarged fragmentary front elevational view showing an upper portion of the display member of FIG. 2 with portions thereof removed to enable the member to be folded into the three dimensional display device;

FIG. 5 is a plan view of the display member of FIG. 2 showing the positional relationship of components forming part of the display member in an intermediate stage when being assembled to form the three dimensional display device;

FIG. 6 is a fragmentary perspective view showing a portion of a corner of the three dimensional display device when the latter has been constructed;

FIG. 7 is a perspective view of the completed three dimensional display device which may be formed from the sheet of material of FIG. 1 and the display member of FIG. 2;

FIG. 8 is an enlarged schematic front elevational view of the display device of FIG. 7;

FIG. 9 is an end elevational view of the display device of FIG. 7;

FIG. 10 is a plan view of the display device of FIG. 7 showing the bottom portion thereof in the opened position;

FIG. 11 is a fragmentary vertical sectional view showing a portion of the interior of one end wall forming part of the display device when formed; and FIG. 12 is a fragmentary vertical sectional view showing a portion of the interior of a front wall forming part of the display device when formed.

DETAILED DESCRIPTION OF A PREFERRED EMBODIMENT

Referring now in more detail and by reference characters to the drawings, 20 designates a sheet of material which has a design 22 on the front surface thereof. In this embodiment, the design includes a first design portion 24 showing portions of the so-called "Betsy Ross" American flag and a second design portion 26 showing portions of the present American flag.

The design on the sheet of material can vary widely, the primary criteria being that the design should conform to and co-operate with the surface contour of the three dimensional display device, as hereinafter described in more detail. Thus, in a preferred embodiment, the design should have horizontal sections which, for example, can represent the stripes of the American flag.

In each case, the first design portion 24 and the second design portion 26 both include sections containing stars along with alternating red and white stripes. The stars in the first design portion 24 could be arranged in an elipse in FIG. 1 so as to form a circular arrangement in the final device, if desired. The stripes will ultimately conform to and identify individual segments on wall sections of the three dimensional display device when formed. In this respect, designs other than flags could be employed on the surface of the sheet of material 20. For example, the design could include rows of bricks, or logs forming part of a log cabin, since they would in effect define horizontal sections which would conform to and partially define a surface contour of a three dimensional object.

The sheet of material of FIG. 1 serves as an art object, as aforesaid, and is capable of being used as a wall hanging poster or like wall covering material. In this connection, the sheet of material can be framed or otherwise mounted and displayed.

The sheet of material 20 is preferably formed of a paper or paperboard material. When formed of a paper material, it should be formed of a fairly thick sheet material so as to have some body thereto. For example, a heavy kraft paper would be suitable for this purpose. More preferably, the sheet of material should be formed from a suitable light-weight paperboard material, or so-called "cover stock" material. The sheet of material should have sufficient body so as to resist undue wrinkling and an inadvertant creation of folds therein, but it should nevertheless be capable of being folded along fold lines (hereinafter described) which are formed in the sheet of material 20.

The term "fold lines", as used in the present invention, represent regions which may have been ruled or areas of reduced thickness such as lines of reduced thickness, enabling the sheet material to be folded. The score lines, on the other hand, represent portions either of reduced thickness or having scores therein such that they may be easily severed or cut. For example, one suitable score may be a series of sequential pin holes formed through the sheet of material. Otherwise, the score line may have areas of reduced thickness capable of being easily severed and include die-cut regions and the like. The term "fold lines" will also be deemed to include score lines as well, except where score lines are separately designated.

The sheet of material is provided with a first set of fold lines 28 which are generally parallel horizontally extending fold lines, as more fully illustrated in FIGS. 1 and 2. The sheet of material is also provided with a second set of fold lines 30, which are generally parallel vertically extending fold lines and which intersect the fold lines 28 at intersection points 32. In addition, the sheet 20 is provided with third sets of fold lines 34 and 35, which are diagonally extending fold lines, as best illustrated in FIGS. 3 and 3A. The fold lines 34, are score lines which represent areas capable of being severed or cut. The fold lines 35 are not score lines, but rather are true fold lines. The fold lines 34 and 35, in this particular case, are located in the regions of the various intersection points 32, in the manner as illustrated in FIGS. 3 and 4, and may be arranged to form opposed triangular shaped areas 36 which are connected together by a pair of spaced apart small vertical fold lines 37 and 37'. The fold line 37' is a score line and portions of the horizontal fold lines 28, designated as 28' are score lines.

The sheet 20 is also provided with a peripheral design score line 38 which extends around the entire periphery of the design 22 on the sheet 20. This score line 38 defines an outer peripheral section 40 of the sheet material 20 which may be removed to thereby produce a design member 42 formed of the sheet material and which has a periphery conforming only to the design 22 on the sheet 20. The removal of the peripheral margin 40 from the sheet 20 constitutes the first step in forming a three dimensional display device 44, which is more fully illustrated in the perspective view in FIG. 7.

After the display member 42 has been obtained by removing the peripheral section 40 of the sheet 20, the various score lines 35, and the score line 28', as best illustrated in FIGS. 3 and 4, may be opened. In this case, the upper and lower score lines 34 along with the vertical score line 37' and the horizontal score lines 28' are opened to provide opposed upper and lower triangular sections 46 and 46' which are removed. Vertically opposed triangular sections 47 and 47' are adjacent the triangular sections 46 and 46' and these sections 47 and 47' are not removed. The score lines 28' form a rectangularly shaped tab 48 which is hinged on the vertical fold line 37, all as best illustrated in FIG. 3A. Removal of triangular sections to form the openings 46 and 46' enable the formation of corner portions having a somewhat serpentine configuration in the three dimensional display device of the present invention.

By further reference to FIG. 4, it can be observed that the individual horizontally extending fold lines 28 form a plurality of first horizontally disposed bands 50 which may be colored, e.g. red in accordance with the design of the present invention and a plurality of second horizontally extending bands 52 which may also be colored, e.g. white in accordance with the present invention. The red bands 50 are adjacent to the white bands in accordance with the design used in this embodiment of the present invention.

Each of the bands 50 and 52 are separated by intermediate bands 54 which will function as inclined wall sections, as hereinafter described in more detail. These intermediate bands 54 are also white colored bands so that in the final device, the bands 52 and 54 appear as contiguous sections. All such bands 50 and 52, however, will serve as flat wall sections in the three dimensional display device as formed, and also as hereinafter described in more detail. Moreover, it can be observed that the intermediate bands have flat rectangularly shaped outer edges 56, and diagonally arranged fold lines 57 thereby providing triangular sections 58' at the outer ends of the intermediate bands 54. These triangular sections 47 and 47' effectively operate to seal any corner openings when the three dimensional device is formed. The bands 50 and 52 have relatively straight outer edges 59 and 60, respectively.

By further reference to FIG. 2, it can be observed that the design member 42 has an enlarged mid-section 62 which is defined by one upper fold line 64, forming part of the horizontally disposed fold lines 28 and one lower fold line 66, both of which form part of the series of first fold lines 28. This mid-section 62 will serve as the top wall in the display device 44, as formed, and as hereinafter described in more detail. Moreover, it can be observed, that other than minor variations in the shape and configuration, the portion of the design member 42 above the fold line 64 is substantially similar to the portion of the shape and configuration of the design member 42 below the fold line 66 and, in effect, constitutes a mirror image thereof, except for a bottom flap 106, as hereinafter described in more detail.

The pair of vertically disposed fold lines 30, which extend for substantially the full vertical length of the design 22, subdivide the design member 42 into an upper right-hand end wall section 68 which will serve as one of the end walls in the three dimensional display device, as formed, and a lower left-hand end wall section 70 which will serve as the opposite end wall in the three dimensional display device, when formed. Individual projecting fingers 72 and 74 are provided which are, in effect, projecting extensions of the individual bands 50 and 52, respectively. These fingers 72 and 74 on the upper left-hand side of the design member 42 will cooperate with the lower left-hand section 70 to form one end wall. In like manner, the individual bands 50 and 52 also have projecting fingers 76 and 78 on the lower right-hand side of the design member 42 which are extensions of the red and white bands 50 and 52, respectively. These fingers 76 and 78 also cooperate with the upper right-hand section 68 to form the opposite end wall of the three dimensional display device, when formed.

The right-hand end wall section 68 is integrally provided at its upper end with a tab 80 and a lower tab 82. In like manner, the left-hand lower end wall section 70 is provided with a downwardly projecting tab 84 and an upwardly projecting tab 86, all for reasons which will presently more fully appear. Finally, a lower downwardly projecting wall section 88, extends downwardly from the lowermost of the bands 50 and which will serve as a cover flap or closure panel, as hereinafter described.

In order to form the three dimensional display device of FIG. 7, from the display member 42, the display member 42 may be folded about the fold lines 64 and 66 to thereby form a front wall 90 bearing the lower design section 26 and a back wall 92 bearing the upper design section 24. The mid-section 62 between the fold lines 64 and 66 will become a top wall 96, in the manner as best illustrated in FIGS. 7 through 9 of the drawings.

The display member 42 is creased along the various fold lines 28 in order to create the individual band sections in the display device, as formed. Thus, the intermediate bands 54 are folded so as to be slightly diagonally located with respect to the bands 50 and 52. Thus, when examining FIG. 4, the upper intermediate band 54 will be creased along the upper fold line 52 so as to extend diagonally inwardly. The intermediate band 54 therebeneath will be creased along its upper fold line to extend slightly diagonally outwardly. In like manner, each of the successive intermediate bands 54 will be diagonally located with respect to the major flat bands 50 and 52 thereby resulting in a wall configuration, as best illustrated in FIGS. 7 and 9.

Thereafter, the upper right-hand end wall section 68 (FIG. 5) is folded 90 degrees about the right side vertical fold line 30 to form a portion of a right-hand end wall 98. The lower right-hand fingers 76 and 78 will similarly be folded 90 degrees with respect to the back wall to form part of the right-hand end wall 98. Further, the left-hand end wall section 70 will be folded at 90 degrees with respect to the back wall 92 (FIGS. 7 and 10). The upper left-hand fingers 72 and 74 (FIG. 4) are similarly folded about the left-side vertical fold line 30 and which will cooperate with and form part of a left-hand end wall 100.

When the above identified components are folded as described, they will assume a configuration somewhat similar to that illustrated in the top plan view of FIG. 5. In this case, it can be observed that the wall sections 68 and 70 are not perpendicularly arranged in FIG. 5, and in like manner, the fingers 72 and 74 and the fingers 76 and 78 also are not at a true right angle, but rather, have been illustrated at a slightly obtuse angle in order to show the initial relationship of the various components before assuming a true perpendicular relationship.

At this point in the assembly, the fingers 76 and 78 are then connected to the end wall section 68 in order to form the right-hand end wall 98. In like manner, the fingers 72 and 74 are connected to the end wall section 70 in order to form the left-hand end wall 100. The fingers 76 and 78 are adhesively secured to the interior surface of corresponding portions of the band 50 and 52 from which they extend. In like manner the fingers 72 and 74 are also adhesively secured to the interior surfaces of the bands 50 and 52 from which they extend. For this purpose, the fingers may be secured to the interior surfaces of the bands by means of adhesives or an adhesive tape or the like. Moreover, portions of the fingers could be provided with an adhesive on their front surfaces covered by releasable backings. Thus, any means of obtaining the securement of the fingers to the interior surface of the corresponding band in the side wall may be employed.

FIG. 11 illustrates an interior view of a portion of an end wall OF the three dimensional display device showing the portions of the fingers 72 which are secured to the interior surface of the left-hand end wall section 70. FIG. 12 illustrates the interior view of the tabs 48 secured to the interior surface of the front wall. When the fingers 72 and 74 have been secured to the end wall and the tabs 48 secured to the front and back walls the device provides an interior cavity or chamber. Moreover, the display device is then capable of being used for storage or retention of objects in this interior chamber.

The bottom wall section or closure panel 88 (FIG. 10) which is hingedly connected to the front wall 90 at a fold line 101 can then be folded over to completely enclose the lower open end of the three dimensional display device 44 and thereby form a bottom wall 102 (FIGS. 8 and 10) for the display device. In addition, the closure panel 88 is provided with an additional fold line 104 which enables an end flange 106 to be tucked in adjacent the interior surface of the rear wall 92. This flange 106 can be bent to be perpendicularly disposed to the wall section 88.

The tab 80 is integrally formed along the upper edge of the uppermost band 50 and is also provided with a fold line 108. In this way, the tab 80 can be bent 90 degrees to extend over the lower open end of the display device, in the manner as illustrated in FIG. 10. In addition, the tab 84 is also connected to one of the lowermost of the bands by means of the fold line 101. In this way, the tab 84 similarly can be folded over to partially enclose the initially opened lower end. Thereafter, the bottom panel 88 can be disposed over the entire open lower end in the manner as previously described.

The tabs 82 and 86 are formed along the respective fold lines 64 and 66. In like manner, these tabs can be folded over and secured to the interior surface of the top wall by means of a suitable adhesive.

In the embodiment as illustrated, it should be observed that the bottom wall is the openable portion of the three dimensional display object. For this purpose, it should be obvious that the sheet could be constructed so as to provide an openable top wall, as opposed to, or in addition to the openable bottom wall.

It can be observed that the initial sheet of material which is capable of being folded into a three dimensional display device is highly effective as a craft for both children and adults, or as a game device. Moreover, depending upon the material from which the sheet is made, it also functions as a highly durable and highly effective display device. It can be observed that the stripes which form part of the American flag literally cooperate with the overall esthetic appearance and construction of the display object. For example, the red stripes protrude beyond the white stripes. Thus, there is a clear demarcation between the red and white stripes.

It should be understood that other designs could be imprinted on the surface of the sheet of material 20 in order to render a different esthetic appearance to the display device. However, it is preferable to employ designs which have band sections corresponding to the actual bands forming part of the exterior wall surface of the display device.

Thus there has been illustrated and described a unique and novel display device and a sheet of material which is capable of being folded into a three dimensional display device and containing a design which conforms to and coacts with the exterior surface contour of the display device. Thus, the present invention fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by Letters Patent is:

1. A decorative display device having a design on a flat face thereof capable of use as a relatively flat suspendable poster and capable of being folded to a three dimensional display object, said display device comprising:

(a) a flat sheet of foldable material initially having a flat front face with upper and lower edges and a pair of spaced apart side edges, (b) a design on the front flat face allowing the device to be suspended in the position of a poster and said design being characterized by a plurality of individual design elements.

(c) a plurality of first fold lines extending across said sheet generally between said spaced apart side edges forming individual segments which extend between said side edges and at least certain of said segments corresponding to certain of the individual design elements, (d) a plurality of second fold lines extending between the upper and lower edges of said sheet permitting folding of said sheet into spaced apart front and back walls and spaced apart side walls forming a three dimensional continuous shell with an initially open interior which is open at its upper or lower end, and (e) one of said first fold lines extending between said side edges forming a closure panel which is integral with and bendable on an edge of one of said walls, said closure panel capable of being bent to be disposed over an end thereby enclosing said continuous shell and forming a three dimensional display device.

2. The decorative display device of claim 1 further characterized in that said second fold lines are generally perpendicular to said first fold lines.

3. The decorative display device of claim 1 further characterized in that a plurality of third fold lines are formed in certain of said segments so that when a three dimensional display device is formed, certain of said segments in the front or back wall of the display device and therefore certain elements of the design have a lengthwise dimension which is less than other of said segments and associated design elements in that wall.

4. The decorative display device of claim 3 further characterized in that when said three dimensional display device is formed, certain of the segments in one of the side walls of said display device and therefore certain elements of the design have a dimension which is less than other of the segments and associated design elements in that wall.

5. The decorative display device of claim 3 further characterized in that said third fold lines are diagonally located with respect to said first fold lines and second fold lines.

6. The decorative display device of claim 5 further characterized in that said third fold lines extend between and contact a pair of adjacent first fold lines and also contact one of said second fold lines.

7. The decorative display device of claim 6 further characterized in that four third fold lines are located in proximity to intersections of certain of said first and second fold lines and that said four third fold lines are located in a generally rectangular arrangement.

8. The decorative display device of claim 6 further characterized in that certain of said third fold lines are score lines and that at least four third score lines are located in proximity to intersections of certain of said first and second fold lines and that said four third score lines are located in a generally rectangular arrangement.

9. A three dimensional decorative display device formed from a single sheet of foldable material having a plurality of fold lines therein thereby forming a plurality of panels therein, said display device comprising:

(a) a plurality of endwise connected wall sections forming a side wall with initially open portions of the display device, (b) a first closure panel integrally connected to at least one of said spaced apart wall sections to close one open portion of said display device, (c) a second closure panel hingedly and integrally connected to another wall section and folded over to close another open portion of the display device to form a completely enclosed three dimensional display device, and (d) each of said wall sections in said single sheet having generally parallel first fold lines arranged so that when folded each of the wall sections on said side wall have lengthwise extending segments, said first fold lines being arranged so that certain of the lengthwise extending segments have a length greater than certain other alternating segments, and said side wall also having a plurality of second fold lines arranged so that when folded, certain of said segments in each of said wall sections have a lengthwise dimension which is less than other of said segments in that wall section thereby providing each wall section with a somewhat corrugated shape between the opposed edges thereof.

10. The decorative display device of claim 9 further characterized in that certain of the corresponding segments in each wall section have a lengthwise dimension greater than each next adjacent alternating segment so that in the final display device, alternating segments of greater length are separated by alternating segments of lesser length.

11. The decorative display device of claim 9 further characterized in that said second closure panel has a flap which is tucked in adjacent an interior surface of one of the wall sections.

12. The decorative display device of claim 9 further characterized in that said first fold lines extend generally horizontally across said sheet and said plurality of second fold lines extending generally vertically on said sheet.

13. The decorative device display of claim 12 further characterized in that said second fold lines intersect certain of said first fold lines and define opposite edges of the segments in each wall section.

14. The decorative display device of claim 13 further characterized in that a plurality of third fold lines are formed in said wall sections so that when a three dimensional display device is formed, certain of said segments in a wall section forming part of the display device have inwardly or outwardly extending portions on said segments.

15. The decorative display device of claim 14 further characterized in that said third fold lines are diagonally located with respect to said first fold lines and second fold lines.

16. The decorative display device of claim 15 further characterized in that certain of said third fold lines extend between and contact a pair of adjacent first fold lines and also contact one of said second fold lines.

17. The decorative display device of claim 16 further characterized in that four third fold lines are located in proximity to intersections of certain of said first and second fold lines and that said four third fold lines are located in a generally rectangular arrangement.

18. The decorative display device of claim 17 further characterized in that certain of said third fold lines are score lines and that at least four third score lines are located in proximity to intersections of certain of said first and second fold lines and that at least some of said four third fold lines are score lines and are located in a generally rectangular arrangement.

19. A sheet of material capable of being suspended or hung for use as a poster when in a flat sheet form and capable of being folded and assembled into a three dimensional display device, said sheet of material comprising:

(a) a plurality of horizontally extending fold lines dividing said sheet into a front wall section and a back wall section with one of said front and back wall sections being initially located above the other, (b) a plurality of vertically disposed fold lines dividing said sheet into one end wall section on the side edge of one of said front or back wall sections and another end wall section on the side edge of the other said front or back wall sections and being diagonally located on said sheet with respect to the first of the end wall sections.

(c) certain of said plurality of horizontally extending fold lines dividing said sheet into a plurality of horizontally disposed segments extending through said front and back wall sections and each of said end wall sections, certain of said horizontally extending fold lines also dividing said sheet into top and bottom wall sections capable of extending between said front and back wall sections when said sheet is folded into the three dimensional object, (d) angularly located fold lines extending with respect to and intersecting certain horizontally disposed fold lines and vertically disposed fold lines at the intersections thereof, said angularly located fold lines and horizontally and vertically extending fold lines cooperating to form corner portions when said sheet is folded into a three dimensional device, and (e) portions of certain of said horizontally extending fold lines and portions of certain of said vertically extending and angularly located fold lines being score lines so that portions of alternate ones of said horizontally disposed segments can be removed leaving some portion of some horizontally disposed segments spaced from next adjacent horizontally disposed segments so that when said sheet is folded into a three dimensional display device horizontially disposed segments in said front and back wall sections or end wall sections can fit into spaces between adjacent horizontally disposed segments in the other of said front and back wall sections or end wall sections.

20. The sheet of claim 19 further characterized in that alternating ones of said horizontally disposed segments in the front and back wall sections have a length which is longer than the other of said horizontally disposed segments in said front and back wall sections.

21. The sheet of claim 20 further characterized in that when said three dimensional display device is formed, certain of the segments in the end wall sections have a length which is longer than the others of the segments in said end wall sections.

22. The sheet of claim 19 further characterized in that said angularly located fold lines are diagonally located with respect to and contact adjacent horizontally disposed fold lines and a vertically disposed fold line.

23. The sheet of claim 22 further characterized in that certain of said angularly located fold lines are score lines and portions of certain of said horizontally extending fold lines are score lines so that portions therebetween can be removed.

24. A method of forming a three dimensional decorative display device from a single sheet of foldable material having a design on a flat face thereof comprised of a plurality of discrete generally horizontal and parallel segments, said sheet of material having a plurality of horizontal fold lines extending across said sheet and a plurality of vertical fold lines and a plurality of diagonal fold lines, said method comprising;

(a) folding said sheet along said horizontal fold lines to form a plurality of vertically spaced apart horizontally extending wall segments with some of the segments so formed protruding beyond the plane of the sheet, certain of the horizontally extending wall segments containing one of the discrete design elements thereon such that each design element is on one of the horizontally extending wall segments.

(b) folding said sheet with the segments therein along said vertical fold lines to divide said sheet into a plurality of wall sections forming a continuous wall with certain of the wall segments protruding beyond certain of the alternate wall segments, and (c) simultaneously with folding the sheet along said vertical fold lines also folding said sheet along the diagonal fold lines to form corner portions, the design elements cooperating with the wall segments to recreate the design on the display device with the design elements protruding beyond alternating design elements thereby recreating a three-dimensional representation of the design on the device.

25. A member capable of being suspended in the form of a sheet of material as a poster and capable of being folded into a three-dimentional display device, said member comprising:

(a) a sheet of a foldable material initially having a flat front face with upper and lower edges and spaced apart side edges, (b) a design on the front face which allows the device to be suspended in the form of a poster and said design having a plurality of horizontally extending individual design elements thereacross, (c) a peripheral score line enabling removal of a portion of the sheet of material to enable the sheet to be folded into a three dimensional display device, (d) a plurality of horizontally extending fold lines dividing said sheet into a front wall section and a back wall section with one of said front and back wall sections being initially located above the other, (e) a plurality of vertically disposed fold lines dividing said sheet into one end wall section on the side edge of one of said front or back wall sections and another end wall section on the side edge of the other of said front or back wall sections and being diagonally located on said sheet with respect to the first of the end wall sections, (f) certain of said plurality of horizontally extending fold lines dividing said sheet into a plurality of horizontally disposed segments extending through said front and back wall sections and each of said end wall sections, and at least certain of the design elements conforming to and being registered with certain of the horizontally extending segments, certain of said horizontally extending fold lines also dividing said sheet into top and bottom wall sections capable of extending between said front and back wall sections when said sheet is folded into the three dimensional object, (g) angularly located fold lines extending with respect to and intersecting certain horizontally disposed fold lines and vertically disposed fold lines at the intersections thereof, said angularly located fold lines and horizontally and vertically extending fold lines cooperating to form corner portions when said sheet is folded into a three dimensional device, and (h) portions of certain of said horizontally extending fold lines and portions of certain of said vertically extending and angularly located fold lines being score lines so that portions of alternate ones of said horizontally disposed segments can be removed leaving some portions of some horizontally disposed segments spaced from next adjacent horizontally disposed segments so that when said sheet is folded into a three dimensional display device horizontally disposed segments in said front and back wall sections or end wall sections can fit into spaces between adjacent horizontally disposed segments in the other of said front and back wall sections or end wall sections.

26. The member of claim 25 further characterized in that alternating ones of said horizontally disposed segments in the front and back wall sections have a length which is longer than the other of said horizontally disposed segments in said front and back wall sections.

27. The member of claim 26 further characterized in that when said three dimensional display device is formed, certain of the segments in the end wall sections have a length which is longer than the others of the segments in said end wall sections.

28. A three dimensional display device formed a single sheet of foldable material having a design on the front flat face thereof characterized by a plurality of horizontally extending design elements and having a plurality of fold lines therein forming a plurality of panels therein, said display device comprising:

(a) a plurality of endwise connected wall sections forming a side wall with initially open portions of the display device, (b) a first closure panel integrally connected to at least one of said spaced apart wall sections to close one open portion of said display device, (c) a second closure panel hingedly and integrally connected to another wall section and folded over to close another open portion of the display device to form a completely enclosed three dimensional display device, and (d) each of said wall sections in said single sheet having generally parallel first fold lines arranged so that when folded each of the wall sections on said side wall have lengthwise extending segments, and said side wall also having a plurality of second fold lines arranged so that when folded, certain of said segments in each of said wall sections have a lengthwise dimension which is less than other of said segments in that wall section thereby providing each wall section with a somewhat corregated shape between the opposed edges thereof, (e) said design elements corresponding to and certain of said design elements being in marginal registration with said lengthwise extending wall sections so that said design corresponds to and has certain elements projecting beyond other elements of said design in the decorative display device.

29. The decorative display device of claim 28 further characterized in that said first fold line extend generally horizontally across said sheet and said plurality of second fold lines extending generally vertically on said sheet.

30. The decorative device display of claim 29 further characterized in that said second fold lines intersect certain of said first fold lines and define opposite edges of the segments in each wall section.

31. The decorative display device of claim 30 further characterized in that a plurality of third fold lines are formed in said wall sections so that when a three dimensional display device is formed, certain of said segments in a wall section forming part of the display device have inwardly or outwardly extending portions on said segments.

* * * * *